United States Patent [19]

Schrenk

[11] Patent Number: 4,621,397

[45] Date of Patent: Nov. 11, 1986

[54] METHOD OF AND APPARATUS FOR PRODUCING EXPANDED METAL

[76] Inventor: Hannes Schrenk, Schneeberggasse 10, A-2700 Wiener Neustadt, Austria

[21] Appl. No.: 754,847

[22] Filed: Jul. 12, 1985

[51] Int. Cl.[4] ..... B21D 31/04

[52] U.S. Cl. ..... 29/6.1

[58] Field of Search ..... 29/6.1

[56] References Cited

U.S. PATENT DOCUMENTS

| | | | |
|---|---|---|---|
| 796,183 | 8/1905 | Bradford | 29/6.1 |
| 3,276,096 | 10/1966 | McAleer et al. | 29/6.1 |
| 4,305,187 | 12/1981 | Iwamura et al. | 29/6.1 |
| 4,486,927 | 12/1984 | Hunter et al. | 29/6.1 |

*Primary Examiner*—Howard N. Goldberg
*Assistant Examiner*—Steven Nichols
*Attorney, Agent, or Firm*—Karl F. Ross; Herbert Dubno

[57] ABSTRACT

An apparatus for producing expanded metal from a metal foil includes a cutting tool which provides the advancing metal foil with intermittent cuts in conveying direction. Arranged at a downstream portion, the apparatus comprises a stretching unit which includes a pair of toothed bottom belts and a pair of toothed top belts which seize and clamp the metal foil along its edges and stretch the latter in a direction transverse to the conveying direction, if necessary, by cooperating with a nose-like ramp interposed between the pair of bottom belts and the pair of top belts.

7 Claims, 9 Drawing Figures

METHOD OF AND APPARATUS FOR PRODUCING EXPANDED METAL

FIELD OF THE INVENTION

My present invention relates to a method of and an apparatus for producing expanded metal from a metal foil, in particular from aluminum foil.

BACKGROUND OF THE INVENTION

Expanded metal is used for various purposes, e.g. to fill containers for combustible liquids or gases, in particular fuel, to prevent explosion-like combustions. In general, the expanded metal used for these purposes is made from very thin aluminum foil of a strength of about 40 $\mu$m.

Apparatus for providing such expanded metal generally make use of knives arranged transversely to the conveying direction of the foil so as to provide small cuts transverse to the conveying direction. Stretching of the foil is obtained by operating the discharge unit of the apparatus at a speed higher than the speed of the feed unit so that the foil is stretched in the conveying direction.

The expanded metal obtained in such a manner has only limited dimensional stability so that the filling with such expanded metal of, e.g. automobile gasoline tanks, balls up after a short period resulting in a loss of its explosion-preventing property.

It has therefore been proposed to produce expanded metal from thicker aluminum foils, e.g. with a thickness of 0.65 to 0.85 mm. However, as it has turned out, the above-described apparatus could not be used with such aluminum foils as their strength was too high to provide an expansion in longitudinal direction of the foil provided with transverse cuts simply by increasing the discharge speed relative to the supply speed.

From the German patent No. 749 689 an apparatus for cutting off wire-like strips from a foil is known in which a cutting unit includes a stationary knife edge and a knife which is designed as a milling cutter and is provided with cutting edges. The continuous cuts as provided by the unit extend perpendicular to the conveying direction of the foil.

The British Pat. No. 1 590 636 discloses an apparatus for profiling metal foils including a pair of rollers having a spacing from each other which is smaller than the thickness of the foil to be profiled. In addition, the rollers have a length which is smaller than the width of the foil so that a partial expansion of the foil is obtained in longitudinal direction during its passage through the pair of rollers. Arranged downstream of the apparatus is a further pair of profiled rollers which provides a profile transverse to the longitudinal direction of the foil in the respective expanded area.

OBJECTS OF THE INVENTION

It is the principal object of my present invention to provide a method of and an apparatus for producing expanded metal from a metal foil with a thickness of 0.65 to 0.85 mm, which apparatus is simple in construction, inexpensive to manufacture and reliable in operation.

Another object is to obviate the drawbacks of prior-art devices.

SUMMARY OF THE INVENTION

I realize this object according to the invention by providing a cutting tool which provides the advancing metal foil with intermittent cuts in a conveying direction and by arranging at a downstream portion a stretching unit expanding the foil in a direction transverse to the conveying direction of the foil.

According to a preferred embodiment of my invention, the stretching unit includes a pair of generally codirectionally extending toothed-periphery lower belts and a pair of generally codirectionally extending toothed-periphery upper belts cooperating with each other such that the metal foil is seized and clamped along its edges between respective upper and lower toothed belts. The belts cooperate with a nose-like ramp which is interposed between the pair of bottom belts and the pair of top belts and lifts the advancing foil out of its linear conveying plane to stretch the latter in a direction transverse to the conveying direction.

Alternatively, the cooperating intermeshing cog belts may, by extending in diverging manner alone, stretch the foil web during its advance in conveying direction. By interposing the ramp as is preferred and the best mode of the invention, the stretching can be further enhanced.

Through the provision of my present invention, it is possible to produce in a simple manner expanded metal from thicker metal foil as known per se, e.g., from aluminum foils having a thickness of 0.65 to 0.85 mm. It is feasible to stretch a foil with a width of 220 mm, e.g. to a width of about 500 mm.

In order to allow stretching of foil webs of arbitrary width, the distance between the pair of belts and/or the angle of slope of the ramp are adjustable.

The cutting tool providing the longitudinal cuts in the foil includes a driven cutting roll bearing against a counter roll. Each roll comprises a plurality of blade disks arranged abreast at a distance to each other. To provide the foil with intermittent cuts, the blade disks of the cutting roll include intermittent cutting edges, i.e. the cutting edges of the cutting roll are not continuous but interrupted through the intermediate recesses.

The motor for driving the cutting roll is operatively connected with a deflection roller arranged ahead of the belts to control the tension of the foil. Accordingly, in case the tension exceeds a predetermined value, the load to which the deflection roller is subjected thus exceeds also a certain value which in turn causes the motor to run at a higher speed resulting in a higher supply speed for the metal foil and thus in a decrease of the tensile stress to a desired degree.

Preferably, guiding and planishing rolls are arranged inbetween the cutting tool and the pairs of toothed belts to smooth the foil and guarantee its full width during transport so that the belts can securely grasp and clamp the foil during stretching.

BRIEF DESCRIPTION OF THE DRAWING

The above and other objects, features and advantages of my present invention will become more readily apparent from the following description, reference being made to the accompanying drawing in which.

SPECIFIC DESCRIPTION

Figure 1:
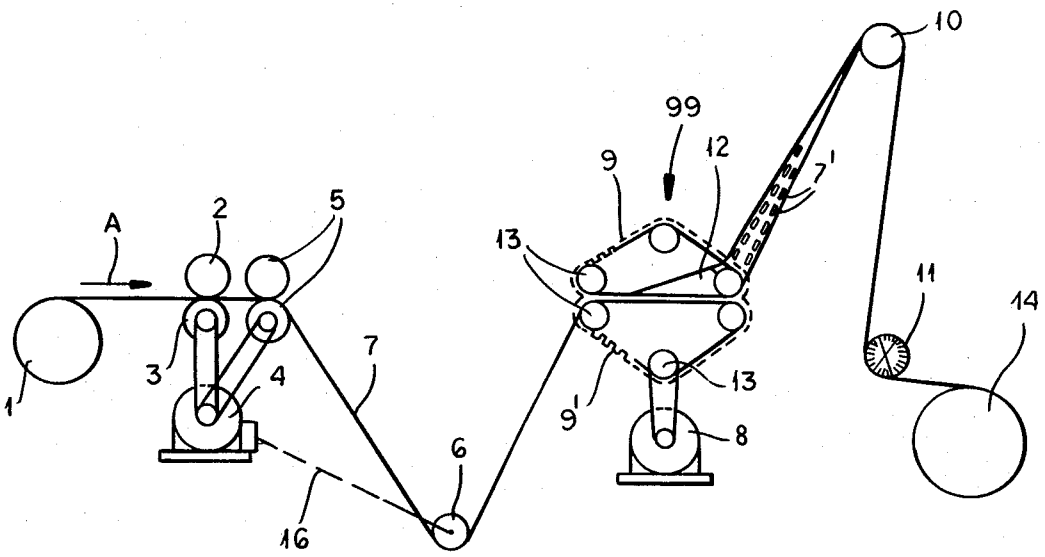
FIG. 1 is a schematic side-elevational view of an apparatus according to the invention.

In the drawing, I have shown an apparatus for producing expanded metal and including a supply coil of metal foil 7, e.g. an aluminum foil which is supplied to a cutting tool 2, 3 for providing the advancing metal foil with intermittently longitudinal cuts in conveying direction. The cutting tool 2, 3 includes a bottom cutting roll 3 which is connected to a motor 4 and bears against a top counter roll 2 in the usual manner so as to define a gap therebetween through which the web of metal foil 7 moves in the direction of arrow A.

Following the cutting tool 2, 3 in downstream direction are tandem guide or planishing rolls 5 for smoothing the surface of the web of metal foil 7 and to guarantee its transport with the entire width. One of the rolls 5 is connected to the motor 4 to simultaneously advance the metal foil 7 which is then deflected by a roller 6 and supplied to a stretching unit 99 for expanding the metal foil 7. After being guided via a further deflection roller 10, the formed expanded metal 7′ is deflected around a brush roll 11 and wound in a coil 14.

As indicated by broken line 16, the deflection roller 6 is operatively connected with the speed regulator of the motor 4 in order to control the speed of the motor 4 in dependence on the tensile stress upon which the metal foil 7 is subjected during its treatmeut and is acting on the deflection roller 6. When the foil 7 is subjected to more than a predetermined tensile stress, the speed of the motor 4 for the cutting tool 2, 3 will be increased so that the supply speed of the metal foil 7 is accordingly increased thus lowering to a desired degree the tensile stress to which the deflection roller 6 is subjected.

Figure 3:
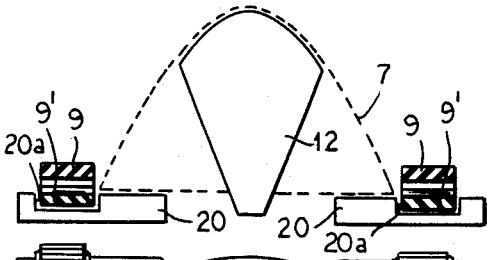
FIG. 3 is a cross-sectional view of the stretching unit of FIG. 2.
Figure 4:
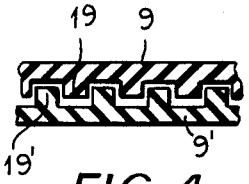
FIG. 4 is a detailed illustration of the stretching unit.
Figure 2:
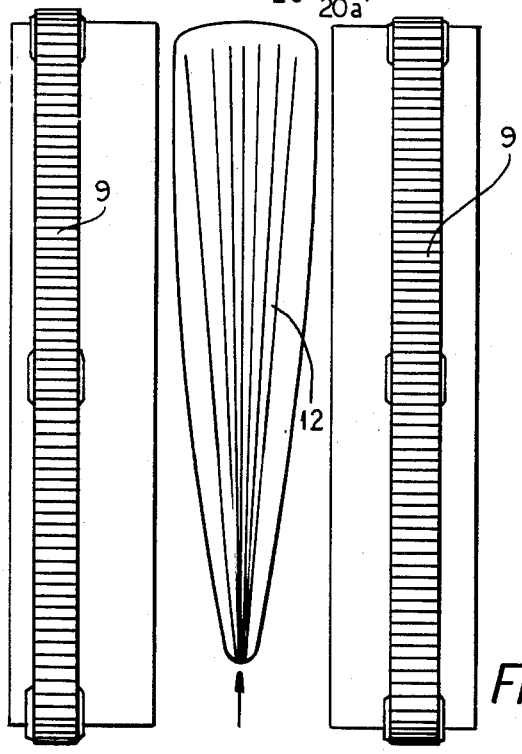
FIG. 2 is a top view of a first embodiment of a stretching unit of the apparatus of FIG. 1.

Turning now especially to FIGS. 2–4, it may be seen that the stretching unit 99 includes a pair of spaced endless bottom belts 9′ and a pair of spaced endless top belts 9. Each pair of belts 9, 9′ extends parallel to each other along the opposing edges of the advancing metal foil 7 and runs over a plurality of rollers 13 of which one, e.g. the lowermost roller 13 of the bottom belt 9′, serving as driving pulley is connected to a motor 8 to provide the necessary drive for the belts 9, 9′.

The belts 9,9′ have toothed profiles 19, 19′ (FIG. 4) cooperating with each other such that the teeth or cogs 19′ of the upper run of the bottom belts 9′ engage in a claw-like manner with the teeth 19 of the lower run of the respectively associated top belts 9 so as to allow the advancing metal foil 7 to be seized and clamped by the belts 9, 9′ along their edges. The bottom belts 9′ are located in guideways 20*a* of respective guideblocks 20 whose distance from each other is adjustable so that metal foils 7 of any arbitrary width are stretchable.

By stretching the foil 7 in a direction transverse to the conveying direction, a shortening of the foil web 7 is obtained which must be considered upon designing the toothed belts 9,9′. Consequently, the belts 9, 9′ are provided with sufficiently high teeth 19,19′ to allow a shortening of the foil web 7 at the edges corresponding to the shortening during stretching.

Extending between the pairs of belts 9, 9′ is a nose-like ramp 12 which gradually slopes in conveying direction to provide the stretching of the advancing metal foil 7. Consequently, when the metal foil is clamped by the toothed belts 9, 9′ and advanced over the ramp 12, the latter will gradually elevate the foil out of its straight conveying plane and stretch it in a direction transverse to the conveying direction while its edge portion is securely fixed by the teeth 19, 19′ of the belts 9, 9′.

Figure 9:
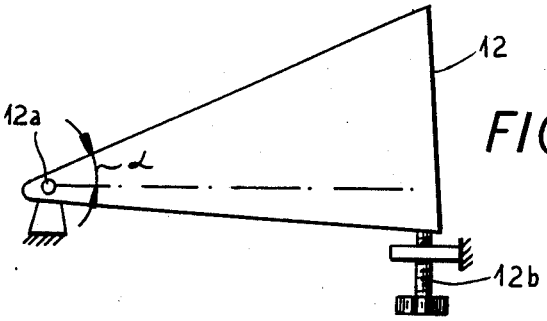
FIG. 9 is a side elevation diagrammatically showing the means for adjusting the guide-body angle.

In order to provide an adjustment to the width and/or the strength of the metal foil 7, the ramp 12 is provided with a means (see FIG. 9) for adjusting the angle $\alpha$ of slope so that, e.g. stretching can be obtained of different degrees. Such means can include a pivot 12*a* for the body 12 and a screw 12*b* for displacing the body 12 adjustably about this pivot.

Figure 5:
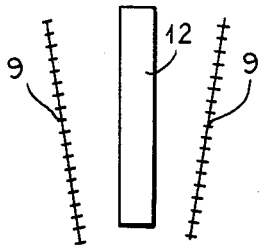
FIG. 5 is a schematic illustration of a second embodiment of the stretching unit.

In FIG. 5, a second embodiment of the belts 9, 9′ is shown, the only difference to the embodiment illustrated in FIG. 2 residing in the fact that the superposed belts 9, 9′ extend in a diverging manner in conveying direction of the foil. Inbetween the belts 9, 9′, the nose-like ramp 12 is provided. Consequently, stretching in a direction transverse to the conveying direction is provided not only by the nose-like ramp 12 but also by the diverging run of the belts 9, 9′.

Figure 6:
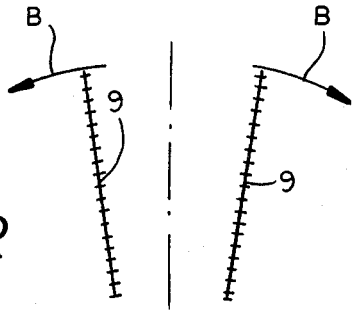
FIG. 6 is a schematic illustration of a third embodiment of the stretching unit.

It is, however, also possible to provide the expansion of the foil 7 solely by the diverging belts 9, 9′ without any ramp 12 extending therebetween. In order to control the degree of expansion, the angle at which the respectively superposed belt pairs 9, 9′ are arranged relative to each other can be altered as indicated by arrows B in FIG. 6. The arrows B represent means for adjusting the separation of the pairs of belts.

Figure 7:
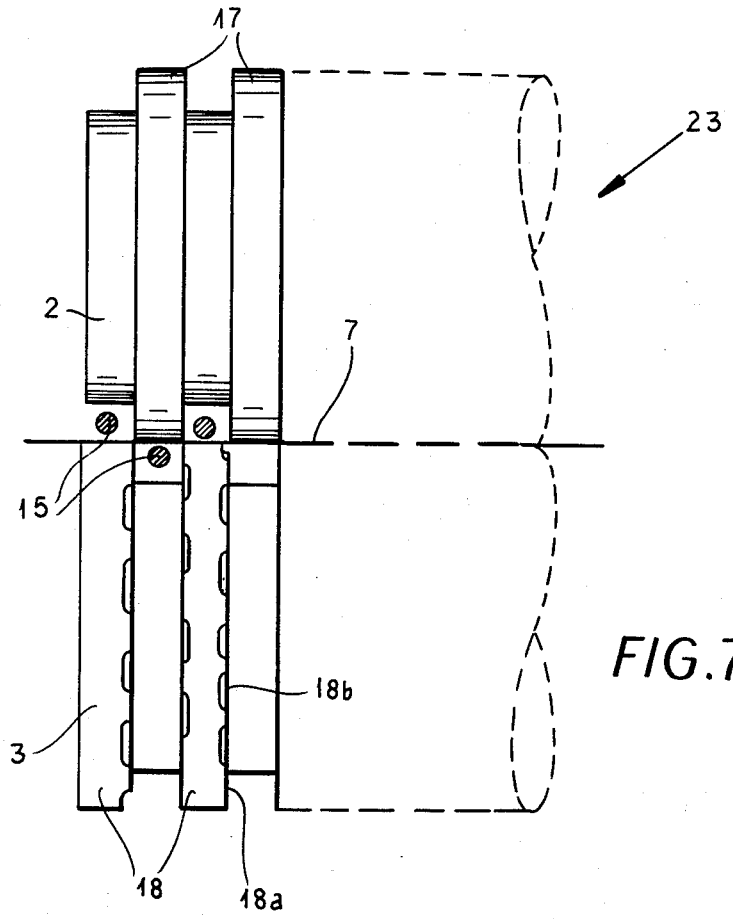
FIG. 7 is a partial front view of a cutting tool of the apparatus of FIG. 1.
Figure 8:
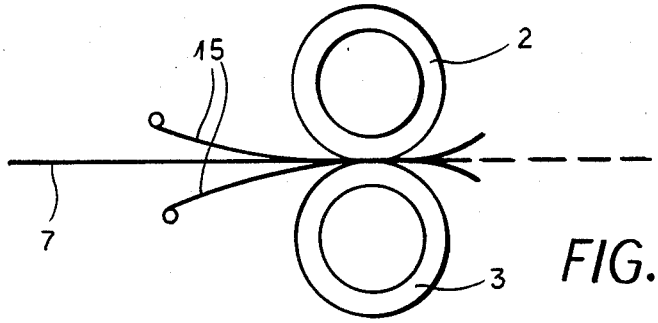
FIG. 8 is a side view of the cutting tool of FIG. 7.

Referring now to FIG. 7 which illustrates the cutting tool 2, 3 for providing the metal foil with intermittent longitudinal cuts, i.e. cuts in conveying direction of the foil 7, it can be seen that the top roll 2 as well as the bottom roll 3 each includes a plurality of knifing or blade disks 17, 18 arranged abreast at a distance to each other. Each knifing disk 18 of the bottom roll 3 is provided with cutting edges 18*a* which do not continuously extend along the circumference of the disk 18 but are interrupted through recesses 18*b* so that the metal foil 7 is provided with intermittent longitudinal cuts in conveying direction A.

It may be noted that any suitable design of the cutting roll 3 which provides such intermittent longitudinal cuts in the foil 7 is to be considered within the scope of this invention. For example, the cutting roll 3 can be provided with projecting knives.

For accurately guiding and supporting the foil 7 during its transport through the cutting tool 2, 3, wires 15 are disposed in conveying direction between the knifing disks 17 of the bottom roll 3 and knifing disks 17 of the top roll 2. The wires 15 thus extend at both sides of the foil 7 beyond the respective rolls 2, 3 and have a certain resiliency so as to be prevented from interfering with the advancing movement of the foil 7.

I claim:

1. An apparatus for reducing expanded metal from a foil strip having a thickness of substantially 0.65 to 0.85 mm, comprising:

transport means for conveying said strip of metal foil in a conveying direction;

cutting means for providing the metal foil with intermittent cuts extending in said conveying direction; and stretching means downstream of said cutting means for expanding the metal foil while it is conveyed in said conveying direction by stretching it in a direction transverse to the conveying direction, said stretching means including:

an upper belt and lower belt forming a respective belt pair having stretches juxtaposed with one another along each longitudinal edge of said strip, the belt pairs along opposite longitudinal edges of said strip diverging in said conveying direction, the upper end and lower belts of each pair along each longitudinal edge being formed with interdigitating teeth engaging the respective longitudinal edges for clamping said longitudinal edges between the respective upper and lower belts, and a nose-like ramp received between the pairs of belts engaging each of said longitudinal edges and having a height increasing progressively in said direction, said ramp widening in said direction whereby said metal foil is stretched in a direction transverse to the conveying direction.

2. The apparatus defined in claim 1, further comprising means for adjusting a spacing between said pairs of belts.

3. The apparatus defined in claim 2, further comprising means for adjusting an angle of slope of said ramp.

4. An apparatus for reducing expanded metal from a foil strip having a thickness of substantially 0.65 to 0.85 mm, comprising:

transport means for conveying said strip of metal foil in a conveying direction;

cutting means for providing the metal foil with intermittent cuts extending in said conveying direction;

stretching means downstream of said cutting means for expanding the metal foil while it is conveyed in said conveying direction by stretching it in a direction transverse to the conveying direction, said cutting means including a cutting roll and a counted roll cooperating with each other, each of said rolls comprising a plurality of knife disks arranged abreast at a distance from one another, said disks being formed with intermittent cutting edges; and a multiplicity of wires arranged between the knife disks of said cutting rolls and between the knife disks of said counter roll extending in said conveying direction along opposite sides of said foil.

5. The apparatus defined in claim 4, further comprising:

guiding and planishing rolls arranged in said direction between said cutting means and said stretching means; and a deflection roller located downstream of said guiding and planishing rolls and upstream of said stretching means and deflectable to control tensions of said web, said cutting means being driven by a motor and said deflection roller being operatively connected with said roller to control the speed thereof.

6. The apparatus defined in claim 4 wherein said stretching means includes an upper belt and a lower belt forming a respective belt pair having stretches juxtaposed with one another along each longitudinal edge of said strip, the belt pairs along opposite longitudinal edges of said strip diverging in said conveying direction, the upper and lower belts of each pair along each longitudinal edge being formed with interdigitating teeth engaging the respective longitudinal edges for clamping said longitudinal edges between the respective upper and lower belts and a noselike ramp received between the pairs of belts engaging said longitudinal edges and having a height progressively increasing in said direction, said ramp widening in said direction whereby said metal foil is stretched in a direction transverse to the conveying direction.

7. A method of producing expanded metal from a strip of a metal foil having a thickness of substantially 0.65 to 0.85 mm, comprising the steps of:

conveying said strip of metal foil in a conveying direction;

cutting said strip of metal foil to provide it with intermittent cuts extending in said conveying direction;

engaging each longitudinal edge of said strip after the formation of said cuts therein between upper and lower toothed belts of a respective belt pair along each longitudinal edge positioned so that teeth of the upper and lower belts of each pair interdigitate and thereby grip the respective longitudinal edges between them; and displacing the strip with the longitudinal edges thus gripped between interdigitating teeth of the belts of each pair in said direction while causing the strip between said pairs of belts to ride up a ramp progressively increasing in height and widening in said direction thereby expanding said strip.

* * * * *